US005346794A

United States Patent [19]

Anzai et al.

[11] Patent Number: 5,346,794

[45] Date of Patent: Sep. 13, 1994

[54] ELECTROPHOTOGRAPHIC TONER

[75] Inventors: Mitsutoshi Anzai; Yuji Matsuura; Osamu Mukudai; Miki Kanno; Kayoko Watanabe, all of Tsukuba, Japan

[73] Assignee: Hodogaya Chemical Co., Ltd., Tokyo, Japan

[21] Appl. No.: 10,575

[22] Filed: Jan. 28, 1993

[30] Foreign Application Priority Data

| | | | |
|---|---|---|---|
| Mar. 3, 1992 | [JP] | Japan | 4-080299 |
| Mar. 3, 1992 | [JP] | Japan | 4-080300 |
| Apr. 22, 1992 | [JP] | Japan | 4-127951 |
| Apr. 22, 1992 | [JP] | Japan | 4-127952 |

[51] Int. Cl.[5] ..... G03G 9/097

[52] U.S. Cl. ..... 430/110

[58] Field of Search ..... 430/106, 109, 110

[56] References Cited

U.S. PATENT DOCUMENTS

| | | | |
|---|---|---|---|
| 5,045,425 | 9/1991 | Swidler | 430/115 |
| 5,200,288 | 4/1993 | Ando et al. | 430/110 |

FOREIGN PATENT DOCUMENTS

| | | |
|---|---|---|
| 2524990 | 10/1983 | France . |
| 56-70557 | 6/1981 | Japan . |
| 56-111856 | 9/1981 | Japan . |
| 58-45024 | 10/1983 | Japan . |
| 62-125367 | 6/1987 | Japan . |
| 2052083 | 1/1981 | United Kingdom . |

*Primary Examiner*—John Goodrow
*Attorney, Agent, or Firm*—Oblon, Spivak, McClelland, Maier & Neustadt

[57] ABSTRACT

An electrophotographic toner containing a compound of the following formula (I):

(I)

wherein each of X and Y which are independent of each other, is a hydrogen atom, (wherein each of $A_1$ and $A_2$ is a hydrogen atom or an electron attracting group, provided that $A_1$ and $A_2$ are not simultaneously hydrogen atoms, $R_1$ is a hydrogen atom, a halogen atom, an alkyl group, a cycloalkyl group, an aralkyl group, an aryl group, an alkoxy group, a dialkylamino group, a diarylamino group, a diaralkylamino group or a hydroxyl group, and n is 0, 1 or 2, provided that when n is 2, the plurality of $R_1$ may be the same or different), (wherein $A_3$ is an electron attracting group, and $R_1$ and n are as defined above), (Abstract continued on next page.)

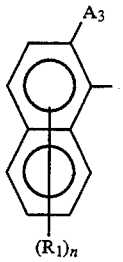

(wherein $A_3$, $R_1$ and n are as defined above),

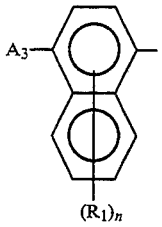

(wherein $A_3$, $R_1$ and n are as defined above) or

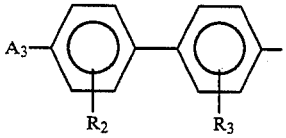

(wherein $A_3$ is as defined above, and each of $R_2$ and $R_3$ is a hydrogen atom, an alkyl group, a cycloalkyl group, an aralkyl group, an aryl group, an alkoxy group or a hydroxyl group), provided that X and Y are not simultaneously hydrogen atoms, and Z is a hydrogen atom, an alkyl group or an aryl group.

10 Claims, No Drawings

ELECTROPHOTOGRAPHIC TONER

The present invention relates to an electrophotographic toner containing a certain specific compound.

In an image-forming process by means of an electrophotographic system, an electrostatic latent image is formed on an inorganic photoconductive material such as selenium, a selenium alloy, cadomium sulfide or amorphous silicon, or on an organic photoconductive material employing a charge-generating material and a charge-transporting material, and the latent image is developed by a toner, then transferred and fixed on a paper sheet or plastic film to obtain a visible image.

The photoconductive material may be positively electrifiable or negatively electrifiable depending upon its construction. When a printed portion is remained as an electrostatic latent image by exposure, development is conducted by means of an oppositely electrifiable toner. On the other hand, when a printed portion is destatisized for reversal development, development is conducted by means of an equally electrifiable toner. A toner is composed of a binder resin, a coloring agent and other additives. However, in order to impart desired tribocharge properties (such as desired charge up speed, tribocharge level and tribocharge level stability), stability with time and environmental stability, it is common to use a charge-control agent. The properties of the toner will be substantially affected by this charge-control agent.

When a positively electrifiable photoconductive material is used for development by an oppositely electrifiable toner, or when a negatively electrifiable photoconductive material is used for reversal development, a negatively electrifiable toner is used. In such a case, a negatively electrifiable charge-control agent is used.

Further, in a case of a color toner, it is necessary to use a colorless charge-control agent or a charge-control agent with a pale color which does not affect the color of the toner. Such pale-colored or colorless charge-control agents may, for example, be metal complex salt compounds of hydroxybenzoic acid derivatives disclosed in e.g. Japanese Examined Patent Publication No. 42752/1980 and Japanese Unexamined Patent Publications No. 69073/1986 and No. 221756/1986, aromatic dicarboxylic acid metal salt compounds disclosed in e.g. Japanese Unexamined Patent Publication No. 111541/1982, metal complex salt compounds of anthranilic acid derivatives disclosed in Japanese Unexamined Patent Publication No. 141453/1986 and No. 94856/1987, organic boron compounds disclosed in e.g. U.S. Pat. No. 4,767,688 and Japanese Unexamined Patent Publication No. 306861/1989 and biphenol compounds disclosed in Japanese Unexamined Patent Publication No. 3149/1986.

However, these charge-control agents have various drawbacks such that some of them are chromium compounds which are likely to bring about environmental problems, some of them are materials which can not be colorless or pale-colored materials, many of them have low electrifying effects or provide oppositely electrifiable toners, or some of them are poor in dispersibility or chemical stability. Thus, none of them has fully satisfactory properties as a charge-control agent.

In a case where a negatively electrifiable photoconductive material is used for development with an oppositely electrifiable toner, or a positively electrifiable photoconductive material is used for reverse development, a positively electrifiable toner is used. In such a case, a positively electrifiable charge-control agent is used.

Further, in a case of a color toner, it is necessary to use a colorless charge-control agent or a charge-control agent with a pale color which does not affect the color of the toner. Such pale-colored or colorless charge-control agents may, for example, be quaternary ammonium salt compounds disclosed in e.g. Japanese Unexamined Patent Publications No. 119364/1982, No. 9154/1983 and No. 98742/1983.

However, these charge-control agents have drawbacks such that even when the toner has high electrifiability at the initial stage for the preparation of the developer, such electrifiability undergoes attenuation depending upon the storage conditions, and such attenuation tends to be remarkable especially when the temperature is high and the humidity is high. On the other hand, the p-halophenylcarboxylic acid disclosed in Japanese Unexamined Patent Publication No. 186752/1983 has a drawback that it is poor in the heat stability. Further, many of the above charge-control agents tend to provide oppositely electrifiable toners and have low electrifying effects. Otherwise, they have a drawback such that they are poor in the dispersibility or chemical stability. Thus, none of them has fully satisfactory properties as a charge-control agent.

The following cases are known in which cinnamic acid or cinnamic acid derivatives are used for electrophotographic toners.

Japanese Examined Patent Publication No. 45024/1983 discloses that a toner having a uniform tribocharge property can be obtained by using a copolymer of cinnamic acid with a vinyl monomer or a mixture of such a copolymer with other polymer having good compatibility, as a resin component for the toner. However, when a charge-control agent is not used, even if an electrifiable property is imparted to the resin, the initial electrification is poor, and an increase in the electrification with time is observed, whereby it has been impossible to obtain a toner which is useful for practical purpose. Japanese Unexamined Patent Publication No. 70557/1981 discloses that a monovalent to trivalent metal salt having a $C_{6-12}$ alkyl group or the like as a substituent, is useful as a polarity-controlling agent for a liquid developer for electrostatic photography. However, when a metal salt of a cinnamic acid derivative is used for a dry toner, no adequate electrifying effect will be obtained, the initial electrification tends to be poor, or the toner will be oppositely electrified, whereby there will be no toner having fully satisfactory properties. Japanese Unexamined Patent Publication No. 111856/1981 discloses that a toner free from fluctuation in the frictional electrification and fogging by development can be obtained by incorporating a certain amount of cinnamic acid to a resin. However, cinnamic acid has a high sublimation property, and it is difficult to use such cinnamic acid by a conventional kneading method. Even if a toner having a certain amount of cinnamic acid can be produced, the electrification tends to increase with time, whereby it has been impossible to obtain a toner useful for practical purpose. Further, Japanese Unexamined Patent Publication No. 125367/1987 discloses that a toner capable of presenting an excellent image quality and having an unpleasant odor suppressed, can be obtained by using a methyl ester or ethyl ester of cinnamic acid. However, there has been no ester of cinnamic acid which is capable of functioning as a charge-control agent.

It is an object of the present invention to provide a charge-control agent which has high chemical stability and good dispersibility to the binder resin and being free from a deterioration during the preparation of a toner and which is capable of presenting a toner which has a good tribocharge property and which is capable of constantly presenting an image of high image quality under various environmental conditions.

The present inventors have found that an aromatic acrylic acid compound having a certain specific site of the aromatic ring substituted by an electron attracting group, is a colorless or pale-colored stable compound which has excellent dispersibility in a binder resin and which is capable of imparting an excellent tribocharge property to a toner, and a better toner can be produced by using this compound as a charge-control agent.

Namely, the present invention provides an electrophotographic toner containing a compound of the following formula (I):

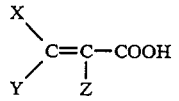

(I)

wherein each of X and Y which are independent of each other, is a hydrogen atom,

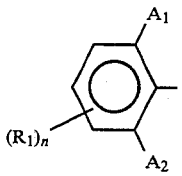

(wherein each of $A_1$ and $A_2$ is a hydrogen atom or an electron attracting group, provided that $A_1$ and $A_2$ are not simultaneously hydrogen atoms, $R_1$ is a hydrogen atom, a halogen atom, an alkyl group, a cycloalkyl group, an aralkyl group, an aryl group, an alkoxy group, a dialkylamino group, a diarylamino group, a diaralkylamino group or a hydroxyl group, and n is 0, 1 or 2, provided that when n is 2, the plurality of $R_1$ may be the same or different),

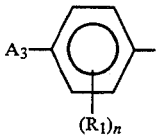

(wherein $A_3$ is an electron attracting group, and $R_1$ and n are as defined above),

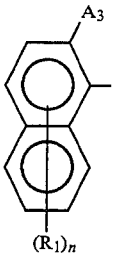

(wherein $A_3$, $R_1$ and n are as defined above),

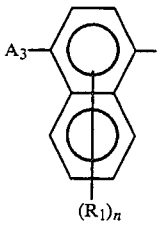

(wherein $A_3$, $R_1$ and n are as defined above) or

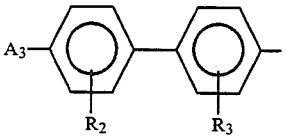

(wherein $A_3$ is as defined above, and each of $R_2$ and $R_3$ is a hydrogen atom, an alkyl group, a cycloalkyl group, an aralkyl group, an aryl group, an alkoxy group or a hydroxyl group), provided that X and Y are not simultaneously hydrogen atoms, and Z is a hydrogen atom, an alkyl group or an aryl group.

Now, the present invention will be described in detail with reference to the preferred embodiments.

Basically, the toner of the present invention comprises a binder resin, a coloring agent and the compound of the formula (I) of the present invention. As a method for producing the toner of the present invention, there may be mentioned a method wherein a mixture of such starting materials are kneaded by a heat-mixing apparatus while the binder resin is melted, and the mixture is then cooled, followed by rough pulverization, fine pulverization and classification, a method wherein a mixture of such starting materials is dissolved in a solvent and then sprayed to form fine particles, followed by drying and classification, or a method wherein the coloring agent and the compound of the formula (I) are dispersed in suspended monomer particles, followed by polymerization.

As the binder resin, a polystyrene, a styrene-methacrylate copolymer, a styrene-propylene copolymer, a styrene-butadiene copolymer, an acrylic resin, a styrene-maleic acid copolymer, an olefin resin, a polyester, an epoxy resin, a polyurethane resin, a polyvinyl butyral, etc., may be used alone or in combination as a mixture.

As the coloring agent, carbon black is commonly used for a black toner. For color toners, the following coloring agents are usually employed. Namely, as a yellow coloring agent, an azo-type organic pigment such as CI pigment yellow 1, CI pigment yellow 5, CI pigment yellow 12 or CI pigment yellow 17, an organic pigment such as yellow oshre, or an oil-soluble dye such as CI solvent yellow 2, CI solvent yellow 6, CI solvent yellow 14 or CI solvent yellow 19, may be mentioned. As a magenta coloring agent, an azo pigment such as CI pigment red 57 or CI pigment red 57:1, a xanthene pigment such as CI pigment violet 1 or CI pigment red 81, a thioindigo pigment such as CI pigment 87, CI violet red 1 or CI pigment violet 38, or an oil-soluble dye such as CI solvent red 19, CI solvent red 49 or CI solvent red 52, may be mentioned. As a cyan coloring agent, a triphenyl methane pigment such as CI pigment blue 1, a phthalocyanine pigment such as CI pigment blue 15 or CI pigment blue 17, or an oil-soluble dye such as CI solvent blue 25, CI solvent blue 40 or CI solvent blue 70, may be mentioned.

Such a coloring agent is used usually in an amount of from 1 to 15 parts by weight, preferably from 3 to 10 parts by weight, per 100 parts by weight of the binder resin.

The electron attracting group in the compound of the present invention useful as a charge-control agent, may, for example, be a fluorine atom, a chlorine atom, a bromine atom, an iodine atom, a halogen-substituted alkyl group such as a trifluoromethyl group, a halogen-substituted aryl group, a cyano group, a formyl group, a carboxyl group, a carbamoyl group, an N-substituted carbamoyl group, an alkoxycarbonyl group, an acyloxy group, an acyl group, an arylcarbonyl group, a nitro group, a sulfonic acid group, an alkylsulfo group, a substituted sulfonyl group, a sulfamoyl group, an N-substituted sulfamoyl group or an substituted sulfinyl group.

The following compounds may be mentioned as specific examples of the compound of the present invention useful as a charge-control agent.

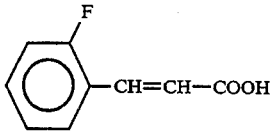

(Compound No. 1)

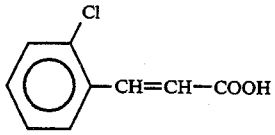

(Compound No. 2)

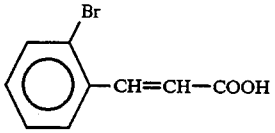

(Compound No. 3)

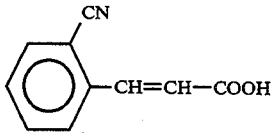

(Compound No. 4)

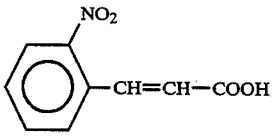

(Compound No. 5)

-continued

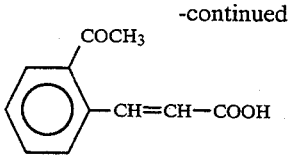

(Compound No. 6)

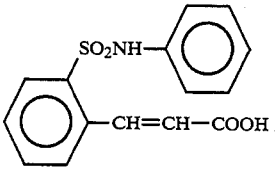

(Compound No. 7)

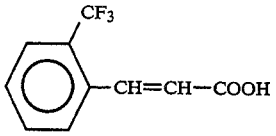

(Compound No. 8)

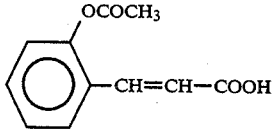

(Compound No. 9)

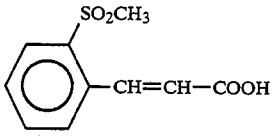

(Compound No. 10)

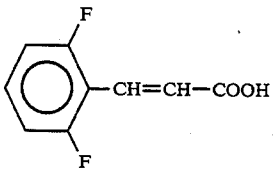

(Compound No. 11)

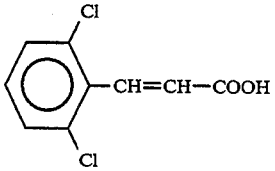

(Compound No. 12)

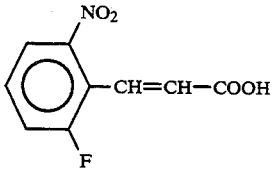

(Compound No. 13)

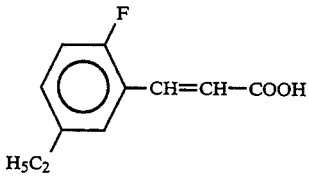

(Compound No. 14)

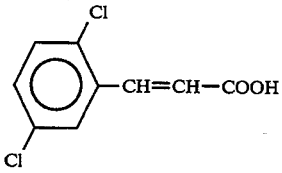

(Compound No. 15)

-continued
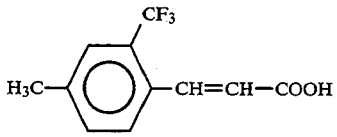
(Compound No. 16)
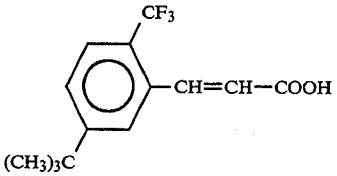
(Compound No. 17)
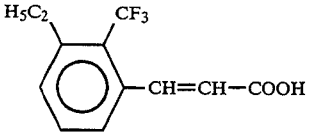
(Compound No. 18)
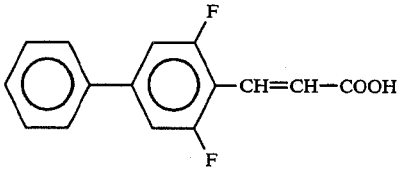
(Compound No. 19)
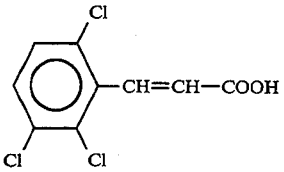
(Compound No. 20)
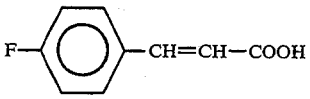
(Compound No. 21)
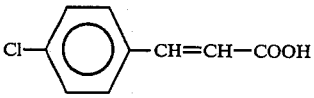
(Compound No. 22)
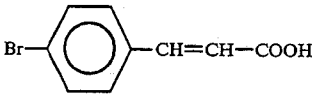
(Compound No. 23)
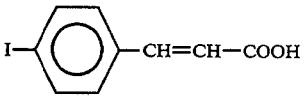
(Compound No. 24)
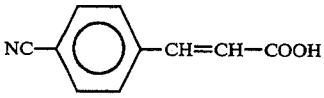
(Compound No. 25)
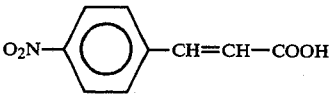
(Compound No. 26)
-continued
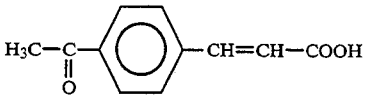
(Compound No. 27)
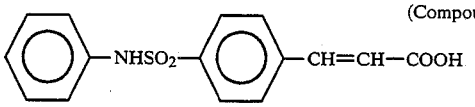
(Compound No. 28)
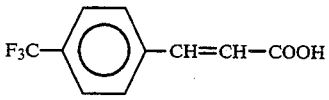
(Compound No. 29)
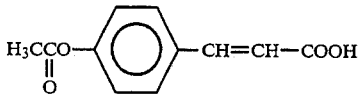
(Compound No. 30)
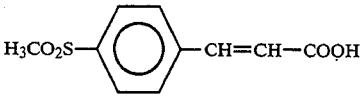
(Compound No. 31)
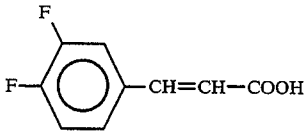
(Compound No. 32)
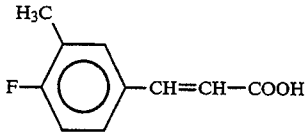
(Compound No. 33)
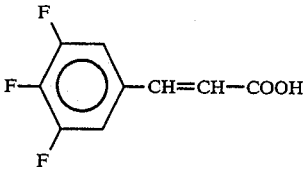
(Compound No. 34)
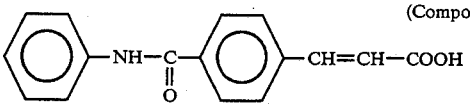
(Compound No. 35)
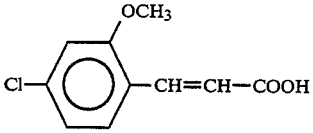
(Compound No. 36)
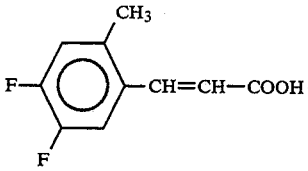
(Compound No. 37)

-continued
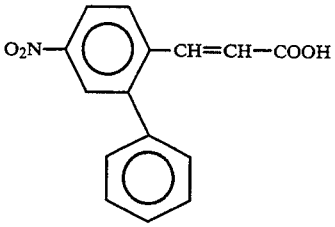
(Compound No. 38)
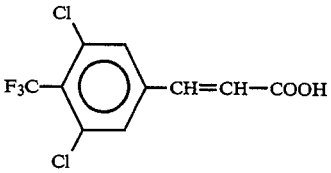
(Compound No. 39)
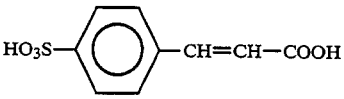
(Compound No. 40)
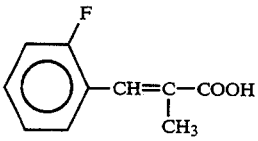
(Compound No. 41)
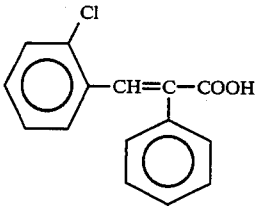
(Compound No. 42)
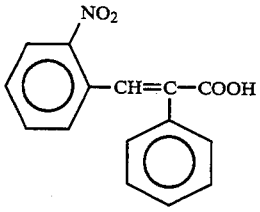
(Compound No. 43)
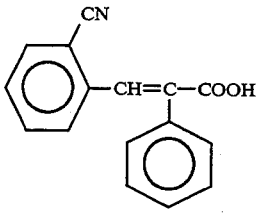
(Compound No. 44)
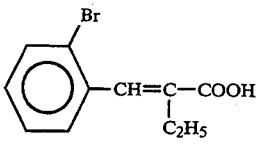
(Compound No. 45)
-continued
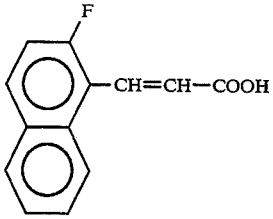
(Compound No. 46)
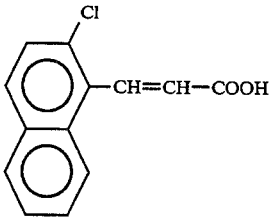
(Compound No. 47)
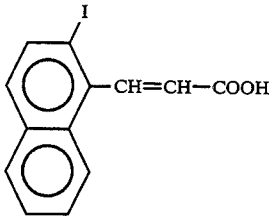
(Compound No. 48)
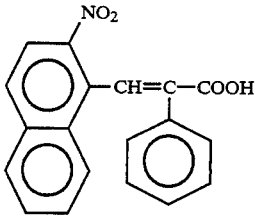
(Compound No. 49)
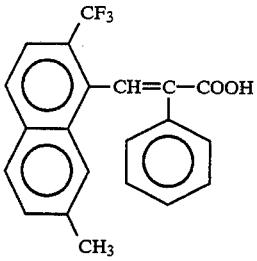
(Compound No. 50)
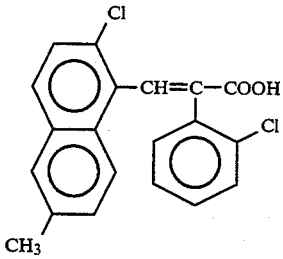
(Compound No. 51)

-continued
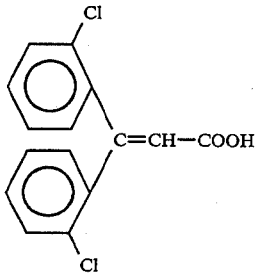
(Compound No. 52)
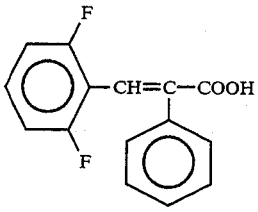
(Compound No. 53)
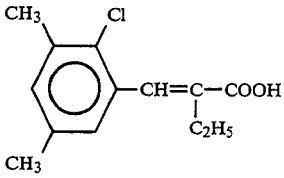
(Compound No. 54)
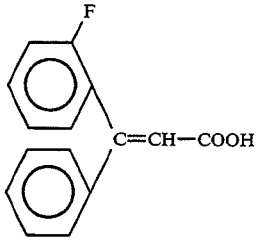
(Compound No. 55)
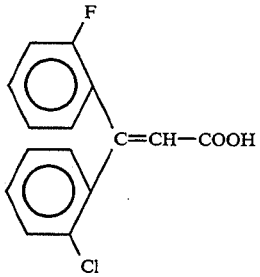
(Compound No. 56)
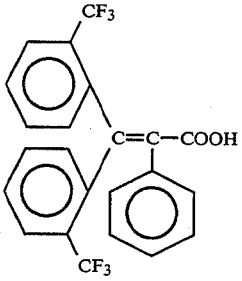
(Compound No. 57)
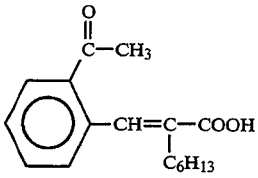
(Compound No. 58)
-continued
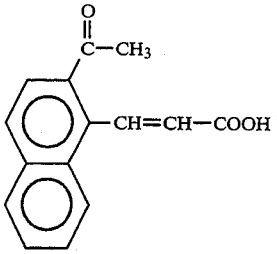
(Compound No. 59)
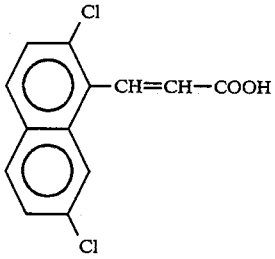
(Compound No. 60)
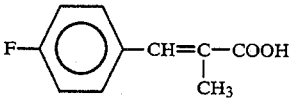
(Compound No. 61)
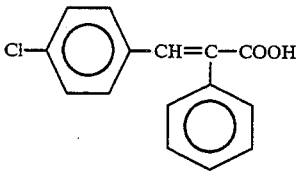
(Compound No. 62)
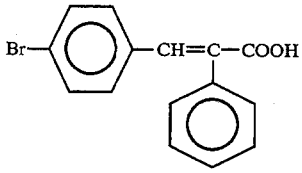
(Compound No. 63)
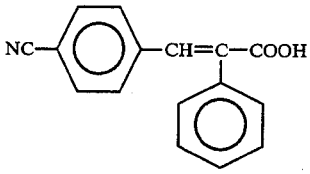
(Compound No. 64)
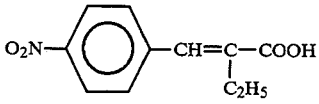
(Compound No. 65)
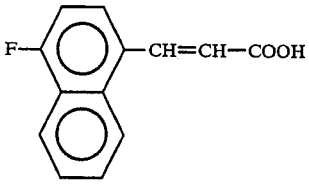
(Compound No. 66)

-continued (Compound No. 67)

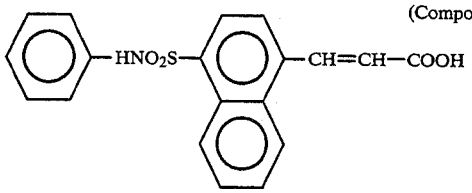

(Compound No. 68)

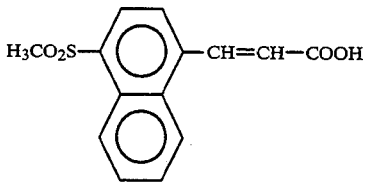

(Compound No. 69)

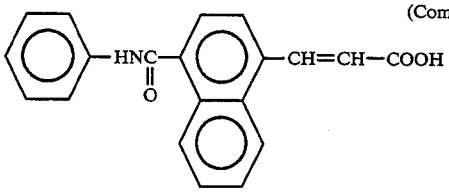

(Compound No. 70)

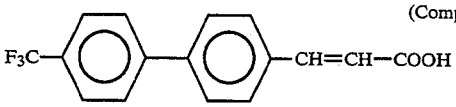

(Compound No. 71)

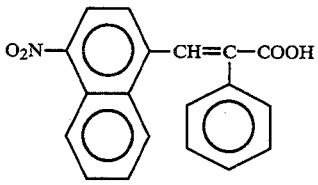

(Compound No. 72)

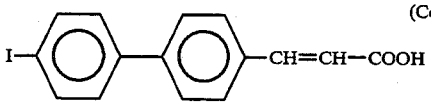

(Compound No. 73)

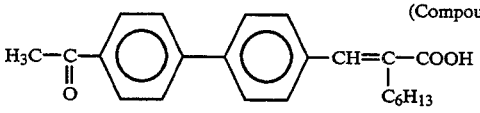

(Compound No. 74)

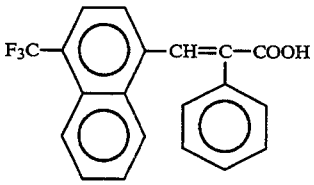

(Compound No. 75)

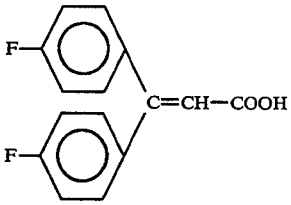

-continued (Compound No. 76)

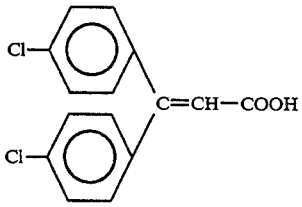

(Compound No. 77)

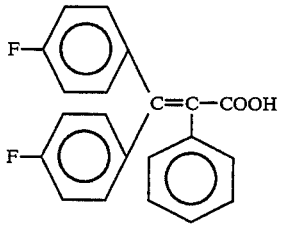

(Compound No. 78)

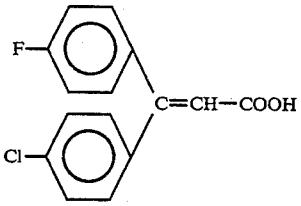

(Compound No. 79)

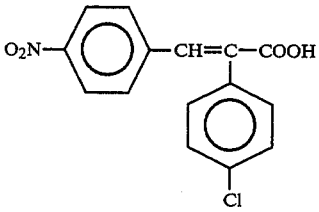

(Compound No. 80)

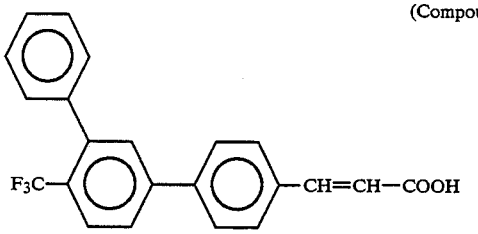

Such a charge-control agent is used usually in an amount of from 0.1 to 10 parts by weight, preferably from 0.5 to 5 parts by weight, per 100 parts by weight of the binder resin.

The toner may further contain various additives such as hydrophobic silica, metal soap, a fluorine-type surfactant, dioctyl phthalate, wax, tin oxide and electrically conductive zinc oxide for the purposes of protecting the photoconductive material or carrier, improving the flowability of the toner, regulating the thermal properties, electrical properties and physical properties, regulating the electrical resistance, regulating the softening point and improving the fixing property.

When the toner of the present invention is used for a two-component developing agent, there may be employed, as a carrier, fine glass beads, iron powder, ferrite powder or a binder-type carrier of resin particles having magnetic particles dispersed therein, or a resin coated carrier having its surface coated with a polyester resin, a fluorine resin, an acrylic resin or a silicon resin. Further, the toner of the present invention exhibits excellent performance when used as a one-component toner.

Now, the present invention will be described in further detail with reference to Examples. However, it should be understood that the present invention is by no means restricted by such specific Examples. In the following Examples, "parts" means "parts by weight".

EXAMPLE 1

One part of 2-fluorocinnamic acid (Compound No. 1), 5 parts of carbon black and 94 parts of a styrene-ethylhexyl methacrylate copolymer were kneaded by a heat-mixing apparatus. After cooling, the mixture was roughly pulverized by a hammer mill, then finely pulverized by a jet mill and classified to obtain a black toner of from 10 to 12 μm. This toner was mixed with an iron powder carrier at a weight ratio of 4:100, and the mixture was shaked, whereby the toner was negatively charged, and the tribocharge was measured by a blow off powder charge measuring apparatus and found to be −30 μc/g. This toner was used to copy an image by a modified commercially available copying machine, whereby copy images with an excellent image quality were obtained not only at the initial stage but also after copying 10,000 sheets.

EXAMPLE 2

One part of 2-chlorocinnamic acid (Compound No. 2), 5 parts of carbon black and 94 parts of a styrene-ethylhexyl methacrylate copolymer were kneaded by a heat-mixing apparatus. After cooling, the mixture was roughly pulverized by a hammer mill, then finely pulverized by a jet mill and then classified to obtain a black toner of from 10 to 12 μm. This toner was mixed with an iron powder carrier at a weight ratio of 4:100, and the mixture was shaked, whereby the toner was negatively charged, and the tribocharge measured by a blow off powder charge measuring apparatus −25 μc/g. This toner was used to copy an image by a modified commercially available copying machine, whereby copy images with an excellent image quality were obtained not only at the initial stage but also after copying 10,000 sheets.

EXAMPLE 3

One part of 2-fluorocinnamic acid (Compound No. 1), 5 parts of Spilon Blue 2BNH as a copper phthalocyanine type oil-soluble dye (product of Hodogaya Chemical Co., Ltd.) and 94 parts of a styrene-butyl methacrylate copolymer were kneaded by a heat-mixing apparatus. After cooling, the mixture was roughly pulverized by a hammer mill, then finely pulverized by a jet mill and classified to obtain a blue toner of from 10 to 12 μm. This toner was mixed with an iron powder carrier at a weight ratio of 4:100, and the mixture was shaked, whereby the toner was negatively charged, and the tribocharge measured by a blow off powder charge measuring apparatus −33 μc/g. This toner was used to copy an image by a modified commercially available copying machine, whereby copy images with an excellent image quality were obtained not only at the initial stage but also after copying 10,000 sheets.

EXAMPLE 4

One part of 2,6-difluorocinnamic acid (Compound No. 11), 5 parts of carbon black and 94 parts of a styrene-ethylhexyl methacrylate copolymer were kneaded by a heat-mixing apparatus. After cooling, the mixture was roughly pulverized by a hammer mill, then finely pulverized by a jet mill and classified to obtain a black toner of from 10 to 12 μm. This toner was mixed with a silicon resin coated carrier at a weight ratio of 4:100, and the mixture was shaked, whereby the toner was negatively charged, and the tribocharge measured by a blow off powder charge measuring apparatus was −15 μc/g. This toner was used to copy an image by a modified commercially available copying machine, whereby copy images with an excellent image quality were obtained not only at the initial stage but also after copying 10,000 sheets.

EXAMPLES 5 TO 10

Experiments were conducted in the same manner as in Example 1 except that the compounds as identified in Table 1 were used instead of 2-fluorocinnamic acid in Example 1, and the results are shown in Table 1.

TABLE 1

| Example No. | Compound No. | Tribo-charge of the toner (μc/g) | Image quality | |
|---|---|---|---|---|
| | | | Initial | After copying 10,000 sheets |
| 5 | Compound No. 3 | −20 | Clear | Clear |
| 6 | Compound No. 5 | −18 | Clear | Clear |
| 7 | Compound No. 8 | −25 | Clear | Clear |
| 8 | Compound No. 12 | −23 | Clear | Clear |
| 9 | Compound No. 14 | −27 | Clear | Clear |
| 10 | Compound No. 17 | −15 | Clear | Clear |

EXAMPLE 11

One part of 4-fluorocinnamic acid (Compound No. 21), 5 parts of carbon black and 94 parts of a styrene-ethylhexyl methacrylate copolymer were kneaded by a heat-mixing apparatus. After cooling, the mixture was roughly pulverized by a hammer mill, then finely pulverized by a jet mill and classified to obtain a black toner of from 10 to 12 μm. This toner was mixed with an iron powder carrier at a weight ratio of 4:100, and the mixture was shaked, whereby the toner was positively charged, and the tribocharge was measured by a blow off powder charge measuring apparatus and found to be +30 μc/g. This toner was used to copy an image by a modified commercially available copying machine, whereby copy images with an excellent image quality were obtained not only at the initial stage but also after copying 10,000 sheets.

EXAMPLE 12

One part of 4-chlorocinnamic acid (Compound No. 22), 5 parts of carbon black and 94 parts of a styrene-ethylhexyl methacrylate copolymer were kneaded by a heat-mixing apparatus. After cooling, the mixture was roughly pulverized by a hammer mill, then finely pulverized by a jet mill and then classified to obtain a black toner of from 10 to 12 μm. This toner was mixed with an iron powder carrier at a weight ratio of 4:100, and the mixture was shaked, whereby the toner was positively charged, and the tribocharge measured by a blow off powder charge measuring apparatus was +25 μc/g. This toner was used to copy an image by a modified commercially available copying machine, whereby copy images with an excellent image quality were obtained not only at the initial stage but also after copying 10,000 sheets.

EXAMPLE 13

One part of 4-fluorocinnamic acid (Compound No. 21), 5 parts of Spilon Blue 2BNH as a copper phthalocyanine type oil-soluble dye (product of Hodogaya Chemical Co., Ltd.) and 94 parts of a styrene-butyl methacrylate copolymer were kneaded by a heat-mixing apparatus. After cooling, the mixture was roughly pulverized by a hammer mill, then finely pulverized by a jet mill and classified to obtain a blue toner of from 10 to 12 μm. This toner was mixed with an iron powder carrier at a weight ratio of 4:100, and the mixture was shaked, whereby the toner was positively charged, and the tribocharge measured by a blow off powder charge measuring apparatus was +33 μc/g. This toner was used to copy an image by a modified commercially available copying machine, whereby copy images with an excellent image quality were obtained not only at the initial stage but also after copying 10,000 sheets.

EXAMPLE 14

One part of 4-fluoro-3-methylcinnamic acid (Compound No. 33), 5 parts of carbon black and 94 parts of a styrene-ethylhexyl methacrylate copolymer were kneaded by a heat-mixing apparatus. After cooling, the mixture was roughly pulverized by a hammer mill, then finely pulverized by a jet mill and classified to obtain a black toner of from 10 to 12 μm. This toner was mixed with a silicon resin coated carrier at a weight ratio of 4:100, and the mixture was shaked, whereby the toner was positively charged, and the tribocharge measured by a blow off powder charge measuring apparatus was +28 μc/g. This toner was used to copy an image by a modified commercially available copying machine, whereby copy images with an excellent image quality were obtained not only at the initial stage but also after copying 10,000 sheets.

EXAMPLES 15 TO 20

Experiments were conducted in the same manner as in Example 11 except that the compounds as identified in Table 2 were used instead of 4-fluorocinnamic acid in Example 11, and the results are shown in Table 2.

TABLE 2

| Example No. | Compound No. | Tribo-charge of the toner (μc/g) | Image quality | |
|---|---|---|---|---|
| | | | Initial | After copying 10,000 sheets |
| 15 | Compound No. 23 | +23 | Clear | Clear |
| 16 | Compound No. 24 | +18 | Clear | Clear |
| 17 | Compound No. 25 | +24 | Clear | Clear |
| 18 | Compound No. 26 | +22 | Clear | Clear |
| 19 | Compound No. 29 | +65 | Clear | Clear |
| 20 | Compound No. 34 | +25 | Clear | Clear |

EXAMPLE 21

One part of Compound No. 41, 5 parts of carbon black and 94 parts of a styrene-ethylhexyl methacrylate copolymer were kneaded by a heat-mixing apparatus. After cooling, the mixture was roughly pulverized by a hammer mill, then finely pulverized by a jet mill and classified to obtain a black toner of from 10 to 12 μm. This toner was mixed with an iron powder carrier at a weight ratio of 4:100, and the mixture was shaked, whereby the toner was negatively charged, and the tribocharge was measured by a blow off powder charge measuring apparatus and found to be −35 μc/g. This toner was used to copy an image by a modified commercially available copying machine, whereby copy images with an excellent image quality were obtained not only at the initial stage but also after copying 10,000 sheets.

EXAMPLE 22

One part of Compound No. 42, 5 parts of carbon black and 94 parts of a styrene-ethylhexyl methacrylate copolymer were kneaded by a heat-mixing apparatus. After cooling, the mixture was roughly pulverized by a hammer mill, then finely pulverized by a jet mill and then classified to obtain a black toner of from 10 to 12 μm. This toner was mixed with an iron powder carrier at a weight ratio of 4:100, and the mixture was shaked, whereby the toner was negatively charged, and the tribocharge measured by a blow off powder charge measuring apparatus was −28 μc/g. This toner was used to copy an image by a modified commercially available copying machine, whereby copy images with an excellent image quality were obtained not only at the initial stage but also after copying 10,000 sheets.

EXAMPLE 23

One part of Compound No. 41, 5 parts of Spilon Blue 2BNH as a copper phthalocyanine type oil-soluble dye (product of Hodogaya Chemical Co., Ltd.) and 94 parts of a styrene-butyl methacrylate copolymer were kneaded by a heat-mixing apparatus. After cooling, the mixture was roughly pulverized by a hammer mill, then finely pulverized by a jet mill and classified to obtain a blue toner of from 10 to 12 μm. This toner was mixed with an iron powder carrier at a weight ratio of 4:100, and the mixture was shaked, whereby the toner was negatively charged, and the tribocharge measured by a blow off powder charge measuring apparatus was −30 μc/g. This toner was used to copy an image by a modified commercially available copying machine, whereby copy images with an excellent image quality were obtained not only at the initial stage but also after copying 10,000 sheets.

EXAMPLE 24

One part of Compound No. 46, 5 parts of carbon black and 94 parts of a styrene-ethylhexyl methacrylate copolymer were kneaded by a heat-mixing apparatus. After cooling, the mixture was roughly pulverized by a hammer mill, then finely pulverized by a jet mill and classified to obtain a black toner of from 10 to 12 μm. This toner was mixed with a silicon resin coated carrier at a weight ratio of 4:100, and the mixture was shaked, whereby the toner was negatively charged, and the tribocharge measured by a blow off powder charge measuring apparatus was −20 μc/g. This toner was used to copy an image by a modified commercially available copying machine, whereby copy images with an excellent image quality were obtained not only at the initial stage but also after copying 10,000 sheets.

EXAMPLES 25 TO 30

Experiments were conducted in the same manner as in Example 21 except that the compounds as identified in Table 3 were used instead of Compound No. 41 in Example 21, and the results are shown in Table 3.

TABLE 3

| Example No. | Compound No. | Tribo-charge of the toner (μc/g) | Image quality | |
|---|---|---|---|---|
| | | | Initial | After copying 10,000 sheets |
| 25 | Compound No. 43 | −25 | Clear | Clear |
| 26 | Compound No. 44 | −20 | Clear | Clear |
| 27 | Compound No. 45 | −23 | Clear | Clear |
| 28 | Compound No. 49 | −18 | Clear | Clear |
| 29 | Compound No. 52 | −15 | Clear | Clear |
| 30 | Compound No. 53 | −17 | Clear | Clear |

EXAMPLE 31

One part of Compound No. 61, 5 parts of carbon black and 94 parts of a styrene-ethylhexyl methacrylate copolymer were kneaded by a heat-mixing apparatus. After cooling, the mixture was roughly pulverized by a hammer mill, then finely pulverized by a jet mill and classified to obtain a black toner of from 10 to 12 μm. This toner was mixed with an iron powder carrier at a weight ratio of 4:100, and the mixture was shaked, whereby the toner was positively charged, and the tribocharge was measured by a blow off powder charge measuring apparatus and found to be +30 μc/g. This toner was used to copy an image by a modified commercially available copying machine, whereby copy images with an excellent image quality were obtained not only at the initial stage but also after copying 10,000 sheets.

EXAMPLE 32

One part of Compound No. 62, 5 parts of carbon black and 94 parts of a styrene-ethylhexyl methacrylate copolymer were kneaded by a heat-mixing apparatus. After cooling, the mixture was roughly pulverized by a hammer mill, then finely pulverized by a jet mill and then classified to obtain a black toner of from 10 to 12 μm. This toner was mixed with an iron powder carrier at a weight ratio of 4:100, and the mixture was shaked, whereby the toner was positively charged, and the tribocharge measured by a blow off powder charge measuring apparatus was +26 μc/g. This toner was used to copy an image by a modified commercially available copying machine, whereby copy images with an excellent image quality were obtained not only at the initial stage but also after copying 10,000 sheets.

EXAMPLE 33

One part of Compound No. 64, 5 parts of Spilon Blue 2BNH as a copper phthalocyanine type oil-soluble dye (product of Hodogaya Chemical Co., Ltd.) and 94 parts of a styrene-butyl methacrylate copolymer were kneaded by a heat-mixing apparatus. After cooling, the mixture was roughly pulverized by a hammer mill, then finely pulverized by a jet mill and classified to obtain a blue toner of from 10 to 12 μm. This toner was mixed with an iron powder carrier at a weight ratio of 4:100, and the mixture was shaked, whereby the toner was positively charged, and the tribocharge measured by a blow off powder charge measuring apparatus was +27 μc/g. This toner was used to copy an image by a modified commercially available copying machine, whereby copy images with an excellent image quality were obtained not only at the initial stage but also after copying 10,000 sheets.

EXAMPLE 34

One part of Compound No. 66, 5 parts of carbon black and 94 parts of a styrene-ethylhexyl methacrylate copolymer were kneaded by a heat-mixing apparatus. After cooling, the mixture was roughly pulverized by a hammer mill, then finely pulverized by a jet mill and classified to obtain a black toner of from 10 to 12 μm. This toner was mixed with a silicon resin coated carrier at a weight ratio of 4:100, and the mixture was shaked, whereby the toner was positively charged, and the tribocharge measured by a blow off powder charge measuring apparatus was +15 μc/g. This toner was used to copy an image by a modified commercially available copying machine, whereby copy images with an excellent image quality were obtained not only at the initial stage but also after copying 10,000 sheets.

EXAMPLES 35 TO 40

Experiments were conducted in the same manner as in Example 31 except that the compounds as identified in Table 4 were used instead of Compound No. 61 in Example 31, and the results are shown in Table 4.

TABLE 4

| Example No. | Compound No. | Tribo-charge of the toner (μc/g) | Image quality | |
|---|---|---|---|---|
| | | | Initial | After copying 10,000 sheets |
| 35 | Compound No. 63 | +17 | Clear | Clear |
| 36 | Compound No. 64 | +20 | Clear | Clear |
| 37 | Compound No. 65 | +15 | Clear | Clear |
| 38 | Compound No. 70 | +19 | Clear | Clear |
| 39 | Compound No. 71 | +25 | Clear | Clear |
| 40 | Compound No. 74 | +37 | Clear | Clear |

COMPARATIVE EXAMPLE 1

A black toner of from 10 to 12 μm was prepared in the same manner as in Example 2 except that calcium 2-chloro cynnamate was used instead of 2-chlorocynnamic acid (Compound No. 2) in Example 2. This toner was mixed with an iron powder carrier at a weight ratio of 4:100, and the mixture was shaked, whereby the toner was not substantially charged, and the electric charge measured by blow off powder charge measuring apparatus was −4 μc/g. With this toner, it was impossible to form an image.

COMPARATIVE EXAMPLE 2

A black toner of from 10 to 20 μm was prepared in the same manner as in Example 2 except that ethyl 2-chlorocynnamate was used instead of 2-chlorocynnamic acid (Compound No. 2) in Example 2. This toner was mixed with an iron powder carrier at a weight ratio of 4:100, and the mixture was shaked, whereby the toner was not substantially charged, and the electric charge measured by a blow off powder charge measuring apparatus was −3 μc/g. With this toner, it was impossible to obtain an image.

We claim:

1. An electrophotographic toner containing a charge control agent of the following formula (I):

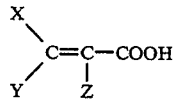

(I)

wherein each of X and Y which are independent of each other, is a hydrogen atom,

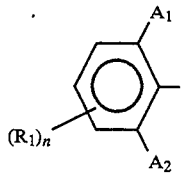

(wherein each of $A_1$ and $A_2$ is a hydrogen atom or an electron attracting group, provided that $A_1$ and $A_2$ are not simultaneously hydrogen atoms, $R_1$ is a hydrogen atom, a halogen atom, an alkyl group, a cycloalkyl group, an aralkyl group, an aryl group, an alkoxy group, a dialkylamino group, a diarylamino group, a diaralkylamino group or a hydroxyl group, and n is 0, 1 or 2, provided that when n is 2, the plurality of $R_1$ may be the same or different),

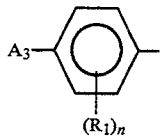

(wherein $A_3$ is an electron attracting group, and $R_1$ and n are as defined above),

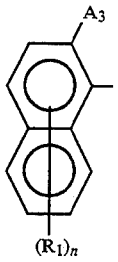

(wherein $A_3$, $R_1$ and n are as defined above),

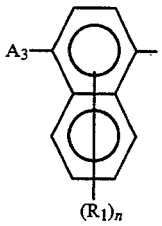

(wherein $A_3$, $R_1$ and n are as defined above) or

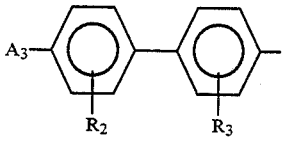

(wherein $A_3$ is as defined above, and each of $R_2$ and $R_3$ is a hydrogen atom, an alkyl group, a cycloalkyl group, an aralkyl group, an aryl group, an alkoxy group or a hydroxyl group), provided that X and Y are not simultaneously hydrogen atoms, and Z is a hydrogen atom, an alkyl group or an aryl group.

2. The electrophotographic toner according to claim 1, which comprises 100 parts by weight of a binder resin, from 1 to 15 parts by weight of a coloring agent and from 0.1 to 10 parts by weight of the compound of the formula (I).

3. The electrophotographic toner according to claim 1, wherein the electron attracting group for each of $A_1$, $A_2$ and $A_3$ is a fluorine atom, a chlorine atom, a bromine atom, an iodine atom, a halogen-substituted alkyl group, a halogen-substituted aryl group, a cyano group, a formyl group, a carboxyl group, carbamoyl group, an N-substituted carbamoyl group, an alkoxycarbonyl group, an acyloxy group, an acyl group, an arylcarbonyl group, a nitro group, a sulfonic acid group, an alkylsulfo group, a substituted sulfonyl group, a sulfamoyl group, an N-substituted sulfamoyl group or a substituted sulfinyl group.

4. The electrophotographic toner according to claim 1, wherein the compound of the formula (I) is one of the following compounds:

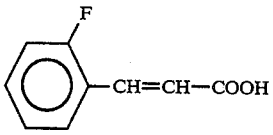

(Compound No. 1)

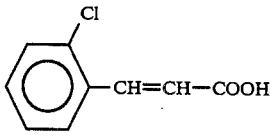

(Compound No. 2)

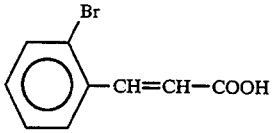

(Compound No. 3)

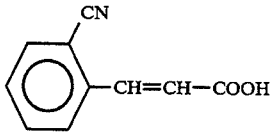

(Compound No. 4)

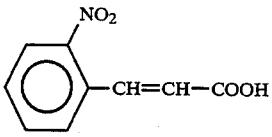

(Compound No. 5)

-continued
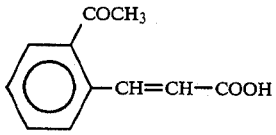
(Compound No. 6)
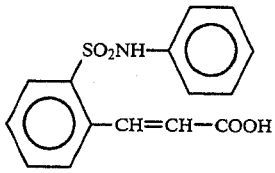
(Compound No. 7)
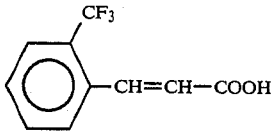
(Compound No. 8)
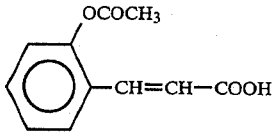
(Compound No. 9)
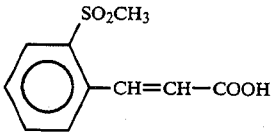
(Compound No. 10)
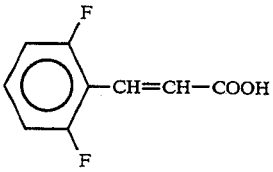
(Compound No. 11)
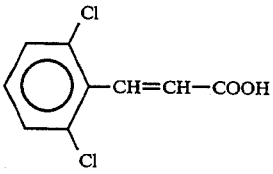
(Compound No. 12)
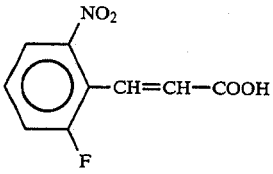
(Compound No. 13)
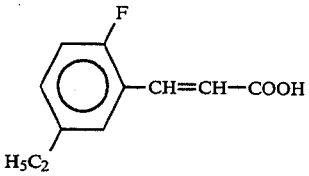
(Compound No. 14)
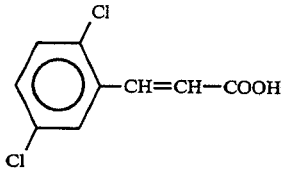
(Compound No. 15)
-continued
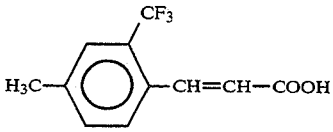
(Compound No. 16)
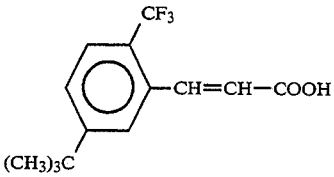
(Compound No. 17)
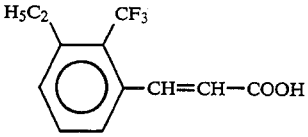
(Compound No. 18)
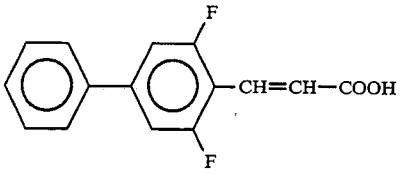
(Compound No. 19)
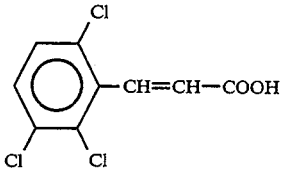
(Compound No. 20)
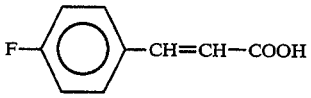
(Compound No. 21)
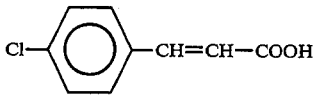
(Compound No. 22)
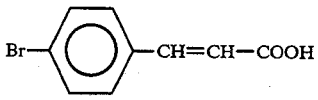
(Compound No. 23)
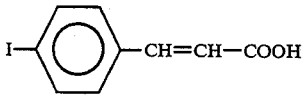
(Compound No. 24)
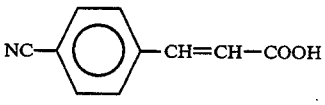
(Compound No. 25)
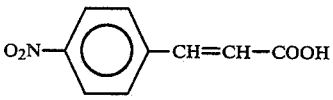
(Compound No. 26)

-continued
(Compound No. 27)
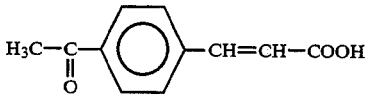
(Compound No. 28)
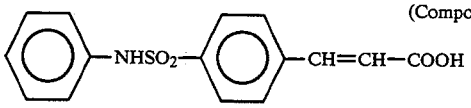
(Compound No. 29)
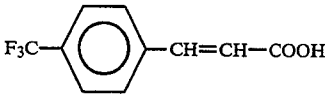
(Compound No. 30)
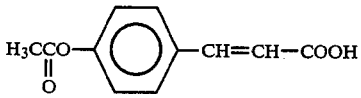
(Compound No. 31)
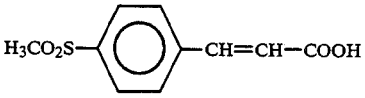
(Compound No. 32)
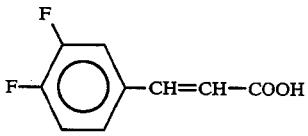
(Compound No. 33)
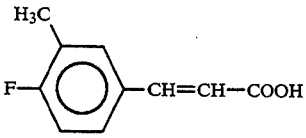
(Compound No. 34)
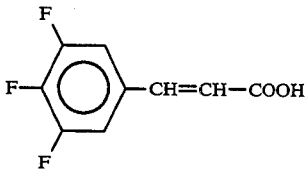
(Compound No. 35)
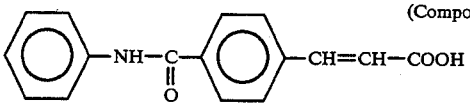
(Compound No. 36)
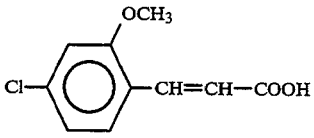
(Compound No. 37)
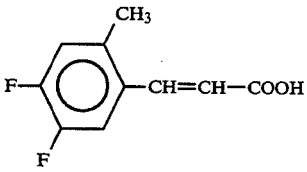
-continued
(Compound No. 38)
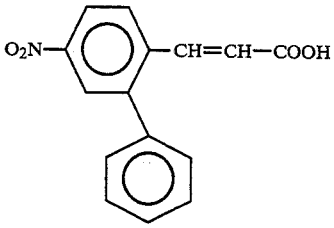
(Compound No. 39)
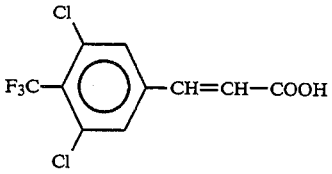
(Compound No. 40)
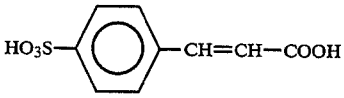
(Compound No. 41)
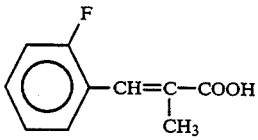
(Compound No. 42)
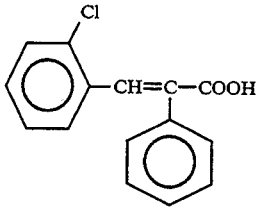
(Compound No. 43)
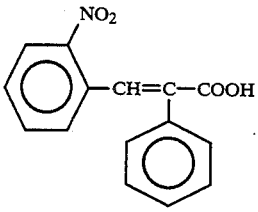
(Compound No. 44)
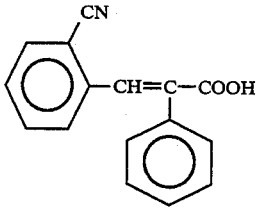
(Compound No. 45)
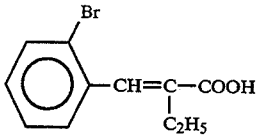

-continued
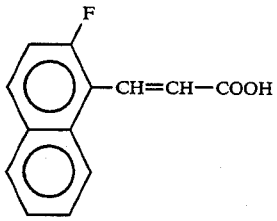
(Compound No. 46)
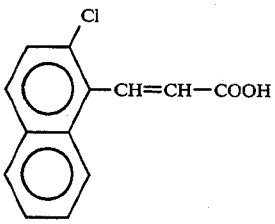
(Compound No. 47)
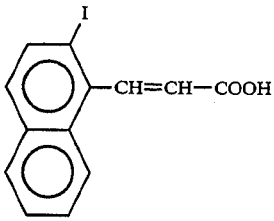
(Compound No. 48)
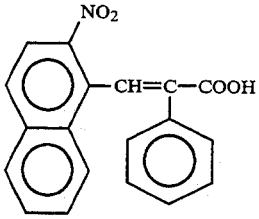
(Compound No. 49)
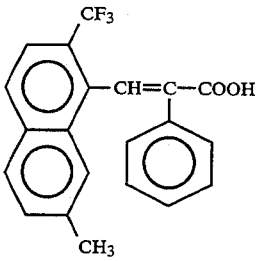
(Compound No. 50)
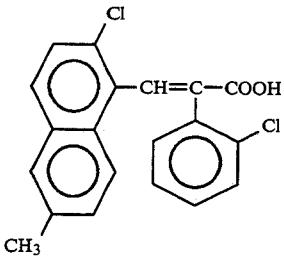
(Compound No. 51)
-continued
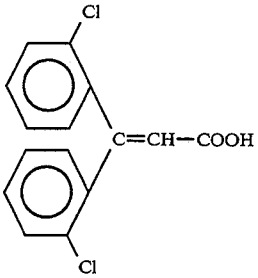
(Compound No. 52)
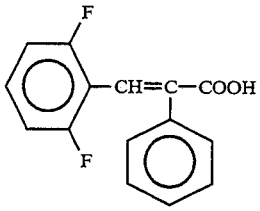
(Compound No. 53)
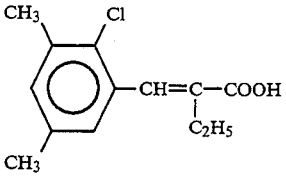
(Compound No. 54)
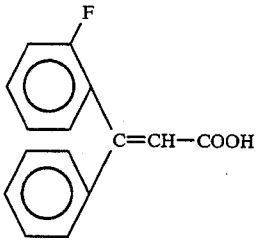
(Compound No. 55)
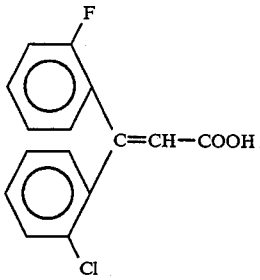
(Compound No. 56)
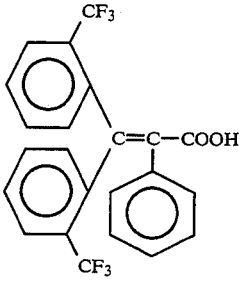
(Compound No. 57)
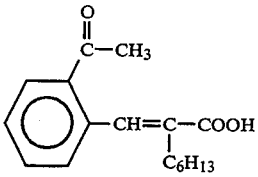
(Compound No. 58)

-continued
(Compound No. 59)
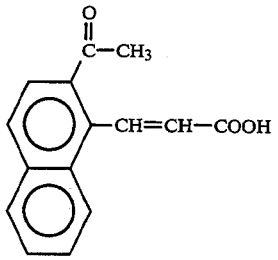
(Compound No. 60)
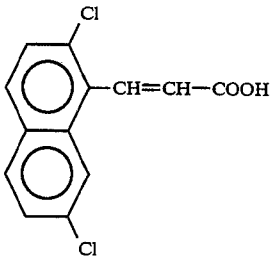
(Compound No. 61)
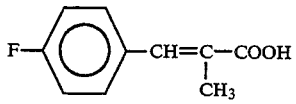
(Compound No. 62)
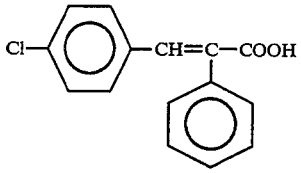
(Compound No. 63)
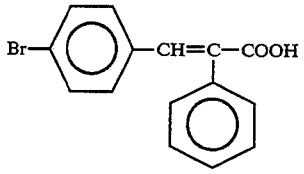
(Compound No. 64)
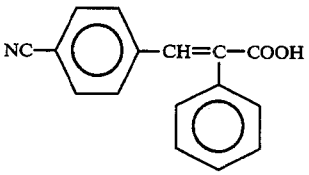
(Compound No. 65)
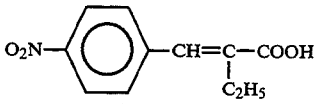
(Compound No. 66)
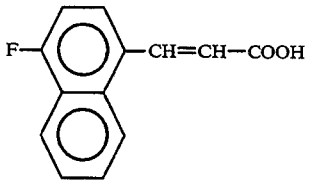
-continued
(Compound No. 67)
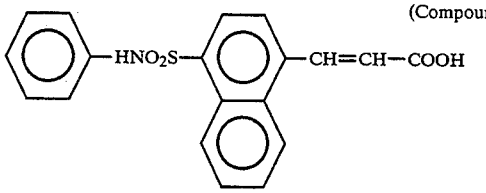
(Compound No. 68)
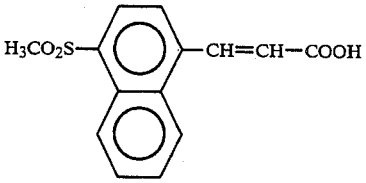
(Compound No. 69)
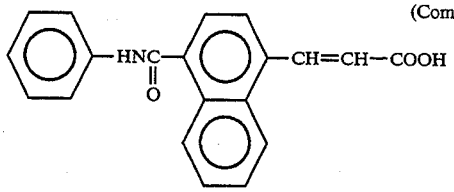
(Compound No. 70)
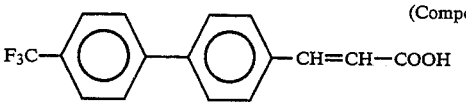
(Compound No. 71)
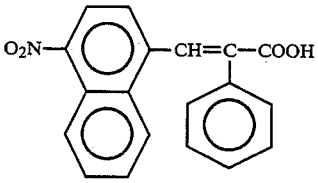
(Compound No. 72)
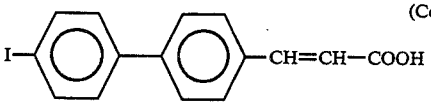
(Compound No. 73)
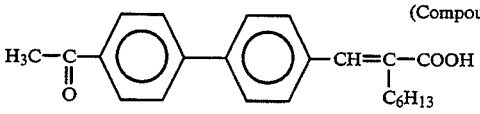
(Compound No. 74)
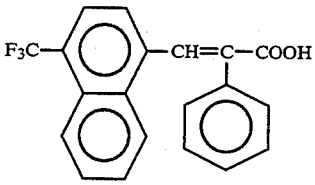
(Compound No. 75)
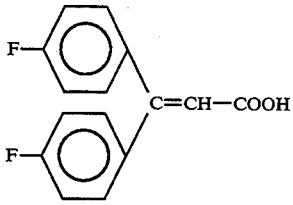

-continued (Compound No. 76)

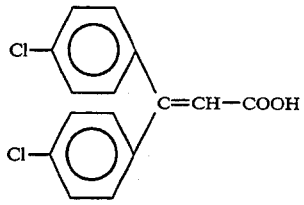

(Compound No. 77)

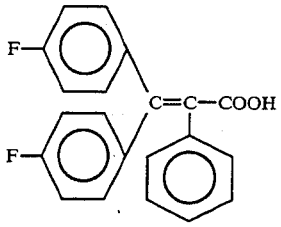

(Compound No. 78)

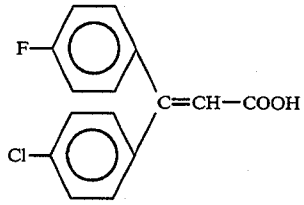

-continued (Compound No. 79)

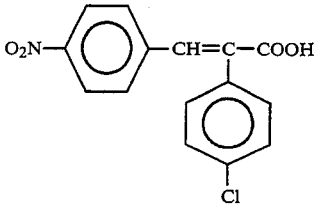

(Compound No. 80)

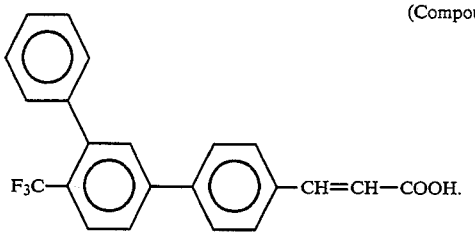

5. The electrophotographic toner according to claim 1, wherein Z is a hydrogen atom.

6. The electrophotographic toner according to claim 1, wherein Z is an alkyl group.

7. The electrophotographic toner according to claim 1, wherein Z is an aryl group.

8. The electrophotographic toner according to claim 1, wherein n is zero.

9. The electrophotographic toner according to claim 1, wherein n is 1.

10. The electrophotographic toner according to claim 1, wherein n is 2.

* * * * *